United States Patent [19]

Dörrie et al.

[11] Patent Number: 5,057,849

[45] Date of Patent: Oct. 15, 1991

[54] ROD ANTENNA FOR MULTI-BAND TELEVISION RECEPTION

[75] Inventors: Horst Dörrie; Uwe Militz, both of Berlin, Fed. Rep. of Germany

[73] Assignee: Robert Bosch GmbH, Stuttgart, Fed. Rep. of Germany

[21] Appl. No.: 448,750

[22] Filed: Dec. 11, 1989

[30] Foreign Application Priority Data

Dec. 20, 1988 [DE] Fed. Rep. of Germany ..... 3842854

[51] Int. Cl.[5] ..... H01Q 5/01; H01Q 9/32

[52] U.S. Cl. ..... 343/722; 343/749; 343/895

[58] Field of Search ..... 343/722, 749, 895, 750, 343/715, 900, 856

[56] References Cited

U.S. PATENT DOCUMENTS

| | | | |
|---|---|---|---|
| 4,145,693 | 3/1979 | Fenwick | 343/722 |
| 4,229,743 | 10/1980 | Vo et al. | 343/749 |
| 4,675,687 | 6/1987 | Elliott | 343/722 |
| 4,730,195 | 3/1988 | Phillips et al. | 343/749 |

*Primary Examiner*—Michael C. Wimer

*Attorney, Agent, or Firm*—Frishauf, Holtz, Goodman & Woodward

[57] ABSTRACT

To provide a single antenna suitable both for VHF as well as UHF television (TV) reception, without changing the length of the antenna, a core support rod (11) of, for example, flexible plastic material is resiliently coupled at one end to a connection terminal (29). Wound on the rod are two connected windings (12, 13), one of them being spiralled with wide spiral turns about the core support rod (11) throughout the major length of the antenna, the other winding (13) being wound closely or tightly thereabout. The two windings are capacitatively coupled by a turn or loop (17) of a third winding (18), pushed between the two last turns (15, 16) of the third winding (13) and electrically connected to the connection terminal (29). The distance ($l_1$) between the third winding (18) and the connection terminal (29) is $\lambda_U/4$, the distance between the end of the first winding (12) and the terminal is $\lambda_U/4$, and which $\lambda_U$ and $\lambda_V$ are, respectively, the average or median wave lengths of the respective UHF and VHF TV signal bands.

19 Claims, 1 Drawing Sheet

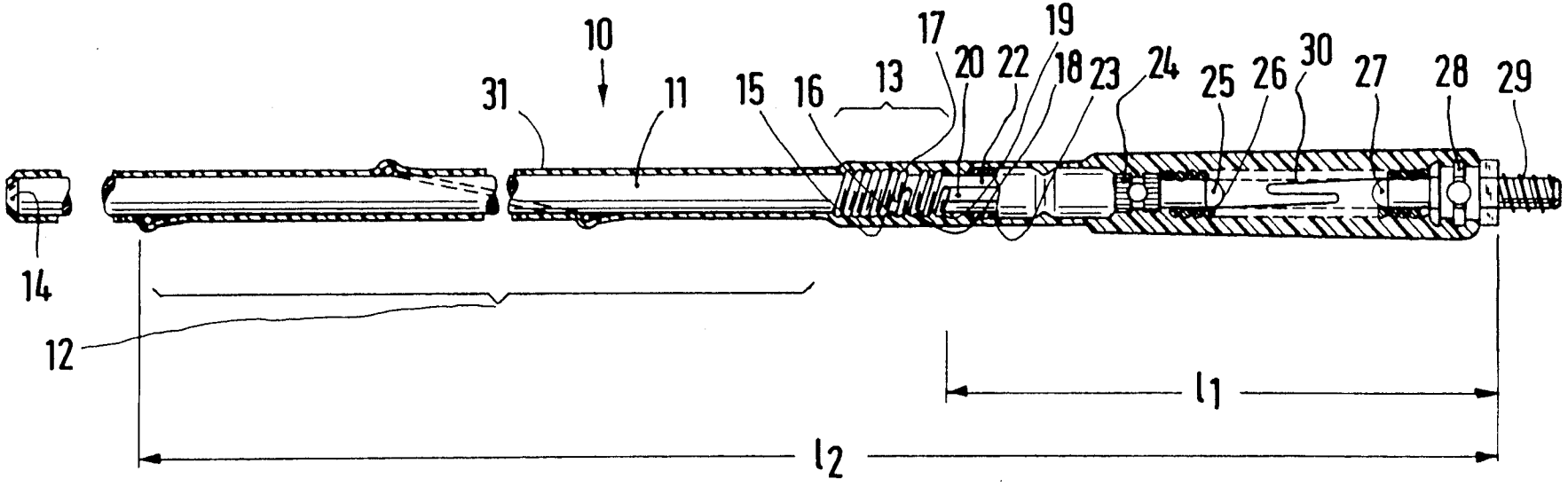
29
28
27
30
26
25
24
23
18
19
22
20
17
13
16
15
11
10
31
14
12
l1
l2

ROD ANTENNA FOR MULTI-BAND TELEVISION RECEPTION

The present invention relates to a rod antenna for multi-band television reception, and more particularly to an antenna structure in which a single rod antenna can be used to receive television signals in the very high frequency (VHF) band as well as signals in the ultra high frequency (UHF) band region.

BACKGROUND

Various types of antenna units are known in the form of telescopic antennas, with which signals both in the VHF as well as the UHF regions can be received by adjusting the length of the telescoping rod of the antenna. If it is desired to change the band range for reception of television signals it is, then, also necessary to manipulate the rod antenna by changing its length by telescoping portions of the antenna together, or to draw them apart.

THE INVENTION

It is an object to provide a rod antenna which can be connected to a multi-band television receiver and which does not require manipulation of the antenna upon change-over of the band range of the receiver, in other words which does not require specific tuning of the antenna to a desired band from which signals are to be received.

Briefly, the rod antenna is an elongated unit with a connection structure, such as a standard screw-in connection at one end and free at the other, and a core of an insulated support rod. Two connected windings are wound around the core, the windings being capacitively coupled to a connecting line to the connection element. One of the windings has only a few and closely spaced turns, the other being spaced along the length of the rod. The capactive coupling is spaced from the connecting end of the rod by a spacing $l_1$ of about $\lambda_u/4$, whereas the end portion of the first winding is spaced from the connection element by a distance $l_2$ of about $\lambda_v/4$ in which $\lambda_u$ and $\lambda_v$ are, respectively, the average or central range of the respective UHF and VHF television operating bands. The length $l_1$, thus, functions as the UHF antenna whereas the dimension $l_2$ functions as the VHF antenna, both of them, however, being capacitively coupled to the connection element.

The structure has the advantage that a single rod antenna can receive signals in various frequency bands or ranges, namely, and for commercial television reception, the VHF and UHF frequency bands, without requiring any physical manipulation of the antenna, or any special tuning thereof.

DRAWING

The single FIGURE is a longitudinal part sectional view of the rod antenna in accordance with the present invention.

DETAILED DESCRIPTION

The rod antenna 10 has a core rod 11 of insulating material, for example plastic, tapering towards an end 14. Two connected windings 12 and 13 are wound about the core rod 11, made of insulating material, made of insulating material. The first winding 12 extends from somewhat inwardly of the free end 14 of the core rod 11 towards the connection end thereof where it can be connected to, or continue as the second winding 13. At the connection end, the antenna 11 is formed with a standard screw connection, for example to screw the antenna into a suitable connector socket. The second winding 13 has at least three turns—see the FIGURE.

The first winding 12 is wound with a low pitch, that is, is slightly spiralled. The turns of the second winding 13 can be wound closely together. A third winding 18 is wound on the rod, the third winding 18 having one end 19 connected to a ribbon or tape-formed conductor 20. The other end of the third winding 18 is wound in a turn or loop 17 which is placed between the last turn 16 remote from end 14, of the second winding 13 and the next to last turn 15 of the second winding 13.

The ribbon or tape shaped conductor 20, as well as the lower end 22 of the insulating core rod 11 are surrounded by a metallic sleeve 23 which, further, surrounds a threaded bolt element 24 at one end. The other end of the threaded bolt 24 supports, or is formed in a threaded pin or rod 25, screwed into a spiral spring 26. The spiral 26 has its other end screwed about a threaded pin or bolt 27 of a second bolt 28 which, at its free end, forms the threaded pin or bolt 29 to secure the rod antenna into a suitable and standard reception socket, e.g. suitable for coupling to a shielded cable. The bolt 28 forms the bottom or base position of the rod antenna. An electrically conductive ribbon or tape 30 passes around and bridges over the spiral spring 26; it is clamped with its ends between the bolt 25 and 27 and the associate ends of the spring 26, to provide a longitudinally extending through-conductor.

The windings 12, 13 and 17 are made of insulated wire, preferably enameled copper wire. The entire rod antenna, with the exception of the projecting threaded bolt portion 29 is covered by an elastic plastic coating 31.

Operation of the Antenna 10

The adjacent or overlapping turns 16 and 17 form a capacitor which connects the windings 12 and 13 with the remaining portion of the rod antenna, namely the sleeve 23 on the first bolt 24, the spring 26, and the second bolt 28, or, the ribbon conductor 30, respectively, shunting the spring.

The length l between the base of the antenna 10 and the third winding 18 has, preferably, a length of $\lambda_u/4$, in which $\lambda_u$ is the average or center wave length of the UHF band. The length $l_2$ between the base and the remote end of the first winding 12 is selected to be about $\lambda_v/4$, in which $\lambda_v$ is the average or central wave length of the VHF range. The length $l_1$ of the rod antenna 10 then functions as a UHF antenna and the length $l_2$ will function as a VHF antenna.

The rod antenna 10 can be screwed with its screw connector 29 in a pivotable base, located, for example, on the roof of a vehicle. This permits tipping the antenna as desired, by about 90° so that it projects vertically upwardly, or can be turned essentially horizontally to form an angle of 0° with respect to the horizontal or, if tipped upwardly, 90° with respect to the horizontal. This permits, selectively, reception of vertically or horizontally polarized waves, in accordance with transmission standards of the transmission to be received. The windings 12, 13 are connected together and can be wound, for example, from a single wire element.

Various changes and modifications may be made within the scope of the inventive concept.

We claim:

1. Rod antenna for multi-band television (TV) reception comprising connection means (29) for coupling output wave energy received by the antenna, said connection means forming one end of said antenna;

a core support rod (11) of insulating material;

resilient means (26) mechanically coupling the connection means (29) to the support rod (11);

a first winding (12) and a second winding (13) wound about said core support rod, said first and second windings being connected together and at least said second winding (13) having at least three turns thereon axially spaced along said core support rod (11)

capacitive coupling means (15, 16, 17) coupled to said windings, wherein said capacitive coupling means (15, 16, 17) comprises a third winding (18) having a turn (17) positioned between the axially last turn (16) of the second winding (13) remote from the first winding (12) and the axially next-to-last turn (15) of the second winding said turn (17) of the third winding being galvanically insulated with respect to the second winding (13); and connecting means (26, 30) coupling said capacitive coupling means to said connection means (29), wherein said capacitive coupling means (15, 16, 17) is spaced from the connection means (29) by a spacing ($l_1$) of about $\lambda_u/4$;

an end portion of the first winding (12) remote from the connection means is spaced from said connection means (29) by a spacing ($l_2$) of about $\lambda_v/4$; and wherein $\lambda_u$ is the median operating wave length of the ultra high frequency (UHF) television signal band, and $\lambda_v$ is the median operating wave length of the very high frequency (VHF) television signal band.

2. The antenna of claim 1, wherein said turn (17) of the third winding (18) comprises an insulated wire.

3. The antenna of claim 1, wherein said first winding (12) is wound with a steep spiral, and said second winding (13) is wound with a spiral turn pitch which is low with respect to the steep spiral.

4. The antenna of claim 3, wherein said second winding (13) comprises closely adjacent turns.

5. The antenna of claim 1, further including an elastic plastic coating (31) surrounding said rod antenna.

6. The antenna of claim 1, wherein said core support rod (11) has a free end portion remote from said connection means (29) free of any winding.

7. The antenna of claim 1, wherein said connecting means include a ribbon or tape shaped conductor (30) electrically bridging said resilient means (26).

8. The antenna of claim 7, wherein said resilient means comprises a spiral spring.

9. The antenna of claim 3, wherein said core support rod (11) has a free end portion remote from said connection means (29) free of any winding.

10. The antenna of claim 5, wherein said core support rod (11) has a free end portion remote from said connection means (29) free of any winding.

11. Rod antenna for multi-band television (TV) reception comprising connection means (29) for coupling output wave energy received by the antenna, said connection means forming one end of said antenna;

a core support rod (11) of insulating material;

resilient means (26) mechanically coupling the connection means (29) to the support rod (11);

a first winding (12) and a second winding (13) wound about said core support rod, said first and second windings being connected together;

capacitive coupling means (15, 16, 17) coupled to said windings; and connecting means (26, 30) coupling said capacitive coupling means to said connection means (29), wherein said capacitive coupling means (15, 16, 17) is spaced from the connection means (29) by a spacing ($l_1$) of about $\lambda_u/4$;

an end portion of the first winding (12) remote from the connection means is spaced from said connection means (29) by a spacing ($l_2$) of about $\lambda_v/4$; and wherein $\lambda_u$ is the median operating wave length of the ultra high frequency (UHF) television signal band, and $\lambda_v$ is the median operating wave length of the very high frequency (VHF) television signal band; and wherein said connecting means include a ribbon or tape shaped conductor (30) electrically bridging said resilient means (26).

12. The antenna of claim 11, wherein said first winding (12) is wound with a steep spiral, and said second winding (13) is wound with a spiral turn pitch which is low with respect to the steep spiral.

13. The antenna of claim 12, wherein said second winding (13) comprises closely adjacent turns.

14. The antenna of claim 11, further including an elastic plastic coating (31) surrounding said rod antenna.

15. The antenna of claim 11, wherein said core support rod (11) has a free end portion remote from said connection means (29) free of any winding.

16. Rod antenna for multi-band television (TV) reception comprising connection means (29) for coupling output wave energy received by the antenna, said connection means forming one end of said antenna;

a core support rod (11) of insulating material;

resilient means (26) mechanically coupling the connection means (29) to the support rod (11);

a first winding (12) and a second winding (13) wound about said core support rod, said first and second windings being connected together;

capacitive coupling means (15, 16, 17) coupled to said windings; and connecting means (26, 30) coupling said capacitive coupling means to said connection means (29), wherein said capacitive coupling means (15, 16, 17) is spaced from the connection means (29) by a spacing ($l_1$) of about $\lambda_u/4$;

an end portion of the first winding (12) remote from the connection means is spaced from said connection means (29) by a spacing ($l_2$) of about $\lambda_v/4$; and wherein $\lambda_u$ is the median operating wave length of the ultra high frequency (UHF) television signal band, and $\lambda_v$ is the median operating wave length of the very high frequency (VHF) television signal band; and wherein said resilient means comprises a spiral spring.

17. The antenna of claim 16, wherein said first winding (12) is wound with a steep spiral, and said second winding (13) is wound with a spiral turn pitch which is low with respect to the steep spiral.

18. The antenna of claim 17, wherein said second winding (13) comprises closely adjacent turns.

19. The antenna of claim 16, wherein said core support rod (11) has a free and portion remote from said connection means (29) free of any winding.

* * * * *